United States Patent [19]

Yoshinaka et al.

[11] Patent Number: 4,960,654

[45] Date of Patent: Oct. 2, 1990

[54] METAL COMPOSITION COMPRISING ZINC OXIDE WHISKERS

[75] Inventors: Minoru Yoshinaka; Eizo Asakura; Mitsumasa Oku, all of Osaka; Takeshi Hamabe, Nishinomiya; Motoi Kitano, Kawanishi; Hideyuki Yoshida, Amagasaki, all of Japan

[73] Assignee: Matsushita Electric Industrial Co., Ltd., Japan

[21] Appl. No.: 399,937

[22] Filed: Aug. 29, 1989

[30] Foreign Application Priority Data

Aug. 29, 1988 [JP] Japan ..... 63-214008
Aug. 29, 1988 [JP] Japan ..... 63-214009

[51] Int. Cl.[5] ..... C22C 32/00
[52] U.S. Cl. ..... 428/614
[58] Field of Search ..... 428/614

[56] References Cited

U.S. PATENT DOCUMENTS 4,134,759 1/1979 Yajima et al. ..... 428/614
4,218,517 8/1980 Van Ooij ..... 428/614
4,226,917 10/1980 Tsuruoka et al. ..... 428/614
4,590,132 5/1986 Dohnomoto et al. ..... 428/614
4,601,956 7/1986 Dohnomoto et al. ..... 428/614
4,704,169 11/1987 Kimura et al. ..... 428/614

FOREIGN PATENT DOCUMENTS 325797 8/1989 European Pat. Off. ..... 428/614

*Primary Examiner*—Theodore Morris
*Assistant Examiner*—David W. Schumaker
*Attorney, Agent, or Firm*—Lowe, Price, LeBlanc, Becker & Shur

[57] ABSTRACT

A metal composition comprising zinc oxide whiskers dispersed in a metal matrix. The whiskers comprise at least one needle crystal having a basal part whose diameter is from 0.7 to 14 micrometers and a length from the basal part to its tip of from 3 to 200 micrometers. The metal composition is isotropically reinforced with respect to mechanical strength and is significantly improved in free cuttability.

18 Claims, 1 Drawing Sheet

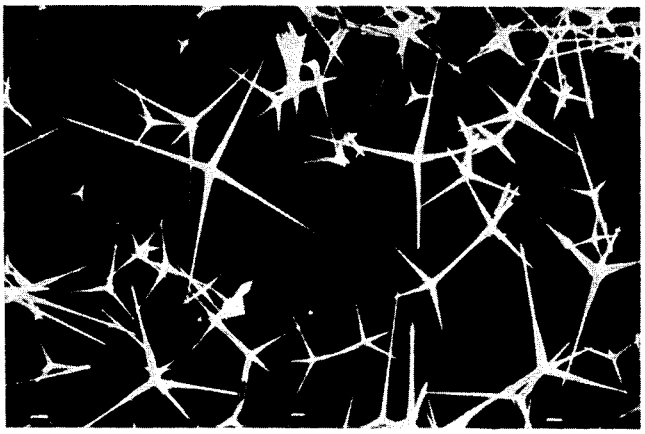
10μm

METAL COMPOSITION COMPRISING ZINC OXIDE WHISKERS

BACKGROUND OF THE INVENTION

1. Field of the Invention

This invention relates to metal compositions and more particularly, to whisker-reinforced metals (WMR) which are suitable for use in aircrafts, space crafts, automobiles, sports goods and the like. Also, it relates to free-cutting metal compositions which are suitably machined by cuttings such as lathing, boring, gear cutting and broaching or by grindings using grinding wheels.

2. Description of the Prior Art

Since whiskers have generally a very small number of dislocations with an attendant advantage that the strength is close to an ideal value of the crystals, they have been used in combination with various metals to improve the strength and the modulus of elasticity. Typical whiskers known in the art include those of $\beta$-SiC, $\alpha$-SiC, $\alpha$-$Si_3N_4$, graphite (C), potassium titanate ($K_2O \cdot 6TiO_2$), $Al_2O_3$, Cu, Fe, W and the like.

When metals are reinforced with these whiskers, not only the strength and the modulus of elasticity are improved, but also high temperature strength is remarkably improved along with an improvement of wear resistance. In addition, as is different from the case of FRM where continuous fibers are used, the whisker-reinforced metals have the advantage that they can be fabricated such as by rolling, extrusion, forging or the like.

On the other hand, for the ease in machining and the high machining accuracy, there is a demand of metal materials which have good free-cutting properties. To this end, attempts have been made wherein various elements or components are added to metals. Some metal compositions have now been put into practice. Known additive components include, for example, elements such as Cu, Pb, S, Mn, Si, C, P, N, Se, Te, Bi and the like, inorganic fillers such as calcium silicate, mica, talc, asbestos, mineral fibers and the like, and inorganic whiskers such as of potassium titanate. For imparting good free-cutting properties, these components have to be undesirably compounded in large amounts.

In particular, the use of known whiskers for reinforcement of metals is not always favorable. The known whiskers are in the form of simple needle-like fibers. When these whiskers are mixed, for example, with a metal in the form of powder or melt and pressure is imposed on the mixture such as by extrusion, the whiskers are apt to be aligned or oriented in one direction along which the pressure has been imposed. This will cause the strength of the mixture to be anisotropic. High strength is obtained along the direction of the alignment, but the effect of the reinforcement considerably decreases along directions which are deviated even only slightly from the alignment direction.

For obtaining high strength, it is general to formulate 15% by volume to 30% by volume or over of the whiskers. The formulation of such a large amount of the whiskers makes composite materials which are too hard from the standpoint of cutting or grinding operations. Thus, the composite materials are difficult to machine.

Moreover, known whiskers are complicated in manufacture process with a poor yield and are thus expensive.

SUMMARY OF THE INVENTION

It is accordingly an object of the invention to provide a metal composition which comprises whiskers of zinc oxide which are effective in improving mechanical strength with good machining properties and which are manufactured at costs lower than known whiskers.

It is another object of the invention to provide a metal composition which is reinforced with zinc oxide whiskers having a crystal form different from a needle or fiber form whereby the anisotropy in strength of the metal composition is significantly reduced or is completely lost.

It is a further object of the invention to provide a metal composition wherein a large amount of zinc oxide whiskers is contained and which has good machinability.

It is a still further object of the invention to provide a metal composition which comprises a controlled amount of zinc oxide whiskers whereby the composition has good free-cutting properties and good mechanical strength.

The above objects can be achieved, according to the invention, by a metal composition which comprises a mixture of a metal and whiskers of zinc oxide dispersed in the metal matrix. Each zinc oxide whisker comprises at least one needle crystal which includes a basal part having a diameter of from 0.7 to 14 micrometers and having a length of from the basal part to the tip of from 3 to 200 micrometers. Preferably, the zinc oxide whiskers should have a crystal form which includes a central body and a plurality of needle crystal projections radially extending from the central body. More preferably, the crystal form includes a central body and four needle crystal projections radially extending from the central body, thereby forming a so-called tetrapod form. However, when mixed with metals, the needle crystal projections tend to break depending upon the manner of the mixing and the length of the needle crystals. Accordingly, the zinc oxide whiskers dispersed in the metal matrix may be a mixture of the whiskers which are in the form of broken needle crystal projections and broken crystals including a central body having at least one needle crystal projection extending from the central body.

Preferably, the metal matrix should be made of at least one member comprised mainly of aluminum, magnesium, titanium and copper. As a matter of course, the member includes alloys of these metals.

BRIEF DESCRIPTION OF THE DRAWINGS

The sole FIG. is an electron micrograph showing the crystals of typical zinc oxide whiskers used in the present invention.

DETAILED DESCRIPTION AND EMBODIMENTS OF THE INVENTION

As described above, the metal composition of the invention comprises a metal matrix and zinc oxide whiskers dispersed in the matrix. Zinc oxide whiskers are first described.

Reference is now made to the accompanying drawing wherein typical zinc oxide whiskers used according to the invention are shown. Each whisker has a central body and a plurality of needle crystals extending radially from the central body and has thus a tetrapod form as is particularly shown in the figure. The number of the needle crystals is mainly four. However, during the course of the manufacture or treatment or compounding of the whiskers, these needle crystal projections may be broken to form whiskers having one, two and/or three needle crystals. The degree of the breakage may depend on the manner of handling of the whiskers. In this sense, the whiskers of the invention should broadly comprise a needle crystal which has a basal part having a diameter of from 0.7 to 14 micrometers and a length of the needle crystal from the basal part to the tip of from 3 to 200 micrometers. As the case may be, the whiskers of the tetrapod form may be fully kept or all the needle crystals may be completely broken. All the shapes of the whiskers of zinc oxide are usable in the metal composition of the invention. In this connection, when compounded in a metal matrix, the whiskers of the tetrapod form are isotropically dispersed. Hence, the whiskers can solve the problem of the anisotropy in one direction with respect to the strength of the final metal composition.

The zinc oxide whiskers used in the invention are pure single crystal whiskers and have high mechanical strength. When the whiskers of the tetrapod form are broken during the course of handling or compounding, needle crystals and the remaining portions of the whiskers contribute to uniform dispersion in metal matrix with the mechanical strength being improved.

Crystallographically, the zinc oxide whiskers are constituted of needle crystals extending along the c axis and have cleavage planes at right angles with respect to the c axis. Accordingly, the whiskers are likely to suffer cleavage. When compounded with metals, the cuttability and grindability are significantly improved. This is true of free-cuttability. In particular, the whiskers whose tetrapod form is kept are preferable in order to impart better free-cuttability.

The zinc oxide whiskers used in the practice of the invention are obtained by thermally treating metallic zinc powder having an oxide film on the surface in an atmosphere containing molecular oxygen. The thermal treatment is effected, for example, at a temperature of from 700 to 1100° C., preferably from 800 to 1050° C. and more preferably from 900 to 1000° C. for 10 seconds or over, preferably from 30 seconds to 1 hour and more preferably from 1 to 30 minutes. Under these conditions, the whiskers can be appropriately controlled with respect to the diameter of the basal part and the length of the needle crystal projection. The resultant whiskers have an apparent bulk specific gravity of from 0.02 to 0.1 g/cc. The whiskers can be mass-produced at a high yield of not lower than 70 wt%. The thus produced whiskers are predominantly made of those which have a tetrapod form with four needle crystal projections extending from a central body. The needle crystal projection should have a diameter of the basal part of from 0.7 to 14 micrometers, preferably from 0.9 to 10 micrometers, and more preferably from 0.9 to 1.8 micrometers and a length of from 3 to 200 micrometers, preferably from 10 to 140 micrometers and more preferably from from 10 to 30 micrometers. A shorter length is more unlikely to break during handling with a greater possibility of keeping the tetrapod form in metal matrix. In some case, other crystal systems including plate crystals may be incorporated along with the tetrapod form crystals. The X-ray diffraction pattern of the whiskers reveals that all the types of whiskers have peaks of zinc oxide. Additionally, the electron beam diffraction pattern reveals that the whiskers exhibit single crystallinity with reduced numbers of dislocations and lattice defects. The results of the atomic absorption spectroscopy reveals that the content of impurities is small and the whiskers are made of 99.98% of zinc oxide.

The zinc oxide whiskers have been defined before with respect to the the diameter of the basal part of the needle crystal extending from the central body and the length extending from the basal part to the tip of the needle crystal. The central body should preferably have a size of from 0.7 to 1.4 micrometers.

If the needle crystals are smaller than those defined above, satisfactory strength cannot be obtained as a whisker-reinforced metal composition. In addition, the ease in processing lowers. On the other hand, larger needle crystals are not favorable because of the difficulty in uniform dispersion with lowerings of the strength and the ease in processing.

The amount of the zinc oxide whiskers in metal composition may vary depending upon the type of metal and the purpose and is thus not critical. However, too small an amount cannot achieve the purpose of the reinforcement and too large an amount will impede characteristic properties inherent to metals and lower processability of the metals with an increase of costs. Accordingly, with whisker-reinforced metal compositions, the whiskers are used in an amount of from 5 to 50% by volume, preferably from 8 to 30% by volume, of the composition.

In order to improve the free cuttability, the whiskers are generally used in an amount of from 0.1 to 50% by volume. A satisfactory effect on the free cuttability develops when using the whiskers only in an amount of from 0.1 to 5% by volume. Better results are obtained using the whiskers in an amount of from 5 to 30% by volume.

The metals used as a matrix in the metal composition of the invention should preferably be light metals having a specific gravity of not higher than 6 such as simple substances mainly composed of aluminum, magnesium and titanium, respectively, alloys of these metals with or without other additive elements. Impurities which may be incorporated in the simple substances and other additive elements will be described hereinafter.

Alternatively, low melting metals having a melting point not higher than 1400° C. may also be used. Such low melting metals include simple substances mainly composed of aluminum, copper, lead, magnesium, tin, zinc, beryllium, calcium, strontium, barium, scandium, lanthanum, manganese, silver, gold, cadmium, mercury, gallium, indium, thalium, germanium, arsenic, antimony, bismuth, selenium, tellurium, uranium, neodium, lithium, sodium, potassium, cesium, cerium rubidium and the like and alloys of two or more metals indicated above with or without other additive elements.

More preferably, a very low melting metal group having a melting point of not higher than 700° C. is preferred. Examples of such very low melting metal group include simple substances mainly composed of aluminum, magnesium, lithium sodium, potassium, rubidium, cesium, zinc, cadmium, mercury, gallium, indium, thalium, tin, lead, antimony, bismuth, selenium and tellurium and alloys of two or more metals indicated above with or without other additive elements.

Of all the elements of the above-mentioned groups, aluminum or its alloys, magnesium or its alloys, copper or its alloys and titanium or its alloys are used, of which aluminum, magnesium or alloys thereof are the best. Next, copper or its alloys are the second best, followed by titanium or its alloys which have high melting points and are slightly difficult to handle. The alloys of Al, Mg, Cu or Ti are those alloys with other elements indicated above with respect to the low melting or very low melting group.

The above simple substances and alloys may further comprise small amounts of high melting metals such as yttrium, zirconium, hafnium, vanadium, niobium, tantalum, chromium, molybdenum, tungsten, iron, ruthenium, osmium, cobalt, rhodium, iridium, nickel, palladium, platinum, technetium, rhenium and the like. In general, the amount ranges up to 1.0 wt% of the substance or alloy. These metals may be contained as inevitable impurities. In addition, carbon, silicon, phosphorus, sulfur and/or halogens may be added to or incorporated, as impurities, in the metal composition. Aluminum alloys containing these high melting metals are useful in the present invention. Preferable aluminum alloys include those alloys Nos. 7075, 2014, 2024, 6061, 2012, 7091, 2618 and the like. Aside from these Al alloys, Al alloy Nos. 2017, 3003, 3203, 5005, 5052, 5154, 5083 and the like may also be used. In addition, Al metals having a purity of not less than 99 wt% are also usable and include, for example, those of Nos. 1080, 1070, 1050, 1100 and the like.

It will be noted that the term "simple substance mainly composed of" a defined metal means that such a simple substance consists of the defined metal at a purity level of not less than 99 wt%.

Aside from the zinc oxide whiskers, whiskers, powders, flakes, long or short fibers of other metals or inorganic materials known in the art may be further added to the metal composition of the invention. These additives are generally used in amounts up to 30% by volume of the metal composition.

The zinc oxide whisker-reinforced metal composition of the invention is manufactured by any known technique including, for example, powder metallurgy, high pressure casting (melt casting), melt dipping, hot pressing, hot rolling, HIP method, high temperature extrusion, vacuum forging, precision forging, die casting and the like.

The present invention is more particularly described by way of examples.

EXAMPLE 1

Zinc oxide whiskers of a tetrapod form whose needle crystal projections or portions had a diameter of from 0.9 to 1.8 $\mu m\phi$ at its basal part and a length from the basal part to the tip of from 10 to 30 micrometers were made. The whiskers were dispersed in aluminum alloy No. 2014 in an amount of 15% by volume and extruded by powder metallurgy at 700° C., thereby obtaining flat test pieces of the aluminum alloy containing the whiskers.

The broken surface of the test piece was observed through a reflection-type electron microscope, revealing that most tetrapod-shaped whiskers were completely left as they were.

The test pieces were subjected to a tensile strength test and also to evaluation of machinability.

The machinability was evaluated totally with respect to the cutting time of the test piece by the use of a saw at a constant pressure, the maximum length of the burr occurring at the cut surface and the surface roughness (Ra) on the cut surface.

The tensile strength was evaluated along the direction of the extrusion and along a direction at right angles to the extrusion direction. The results are shown in Table 1.

EXAMPLE 2

The general procedure of Example 1 was repeated except that whiskers used were mainly composed of zinc oxide whiskers of a tetrapod form whose needle crystal projections or portions had a diameter of the basal part of from 1.8 to 3.2 $\mu m\phi$ and a length of from the basal part to the tip of from 20 to 50 micrometers, thereby obtaining flat test pieces of the aluminum alloy. The broken surface of the test piece was similarly observed, revealing that the half of the whiskers was broken into those having three, two and/or one needle and the other half was left as tetrapod-shaped whiskers. This test piece was similarly evaluated. The results are shown in Table 1.

EXAMPLE 3

The general procedure of Example 1 was repeated except that whiskers used was zinc oxide whiskers of a tetrapod form whose needle crystal projections had a diameter of the basal part of from 4 to 10 $\mu m\phi$ and a length of from the basal part to the tip of from 50 to 140 micrometers, thereby obtaining flat test pieces of the aluminum alloy. The observation of a broken surface revealed that most whiskers were broken into pieces of one needle crystal. This test pieces was similarly evaluated with the results shown in Table 1.

COMPARATIVE EXAMPLES 1 TO 9

For comparison, the general procedure of Example 1 was repeated using filler-free aluminum alloy No. 2014, combinations of the alloy No. 2014 and, as a filler, $\beta$-SiC whiskers, potassium titanate whiskers, $Al_2O_3$ whiskers, tungsten whiskers, $Al_2O_3$ powder, zinc white obtained by the French method with an average size of 0.52 micrometers, larger-sized zinc oxide whiskers whose needle crystal projections had a diameter of the basal part of from 14 to 20 micrometers and a length of from 200 to 300 micrometers, and smaller-sized zinc oxide whiskers whose needle crystal projections had a length of from 0.5 to 3 micrometers and a basal part diameter of from 0.05 to 0.7 micrometers, thereby obtaining aluminum alloy test pieces with or without containing the above fillers. These test pieces were evaluated in the same manner as in Example 1. The results are shown in Table 1.

TABLE 1-1

| | | Tensile Strength (Index to the strength of Comparative Example 1) | |
|---|---|---|---|
| | Filler | Direction of Extrusion | Direction at Right Angles to the Extrusion Direction |
| Example 1 | zinc oxide whiskers (1) | 137 | 133 |
| Example 2 | zinc oxide whiskers (2) | 151 | 124 |
| Example 3 | zinc oxide whiskers (3) | 165 | 112 |
| Comp. Ex. | | | |
| 1 | no | 100 | 98 |
| 2 | $\beta$-SiC whiskers | 141 | 101 |
| 3 | potassium titanate whiskers | 131 | 85 |

TABLE 1-1-continued

| | Filler | Tensile Strength (Index to the strength of Comparative Example 1) Direction of Extrusion | Direction at Right Angles to the Extrusion Direction |
|---|---|---|---|
| 4 | $Al_2O_3$ whiskers | 146 | 89 |
| 5 | W whiskers | 150 | 94 |
| 6 | $Al_2O_3$ powder | 106 | 107 |
| 7 | Zinc white #1 | 85 | 83 |
| 8 | Large-sized zinc oxide whiskers | 125 | 96 |
| 9 | Smaller-sized zinc oxide whiskers | 101 | 99 |

Note:
the values indicated are each an average value of 10 measurements.

TABLE 1-2

| | Filler | Machinability: Cutting Time (Index to that of Comp. Ex. 1) | Maximum Length Burr (mm) | Surface Roughness, Ra, (μm) | Evaluation on Cost |
|---|---|---|---|---|---|
| Example 1 | zinc oxide whiskers (1) | 47 | 0.32 | 51 | very low |
| Example 2 | zinc oxide whiskers (2) | 43 | 0.33 | 45 | very low |
| Example 3 | zinc oxide whiskers (3) | 41 | 0.21 | 40 | very low |
| Comp. Ex. | | | | | |
| 1 | no | 100 | 4.1 | 220 | — |
| 2 | β-SiC whiskers | 180 | 4.0 | 180 | very high |
| 3 | potassium titanate whiskers | 160 | 3.9 | 175 | high |
| 4 | $Al_2O_3$ whiskers | 190 | 4.9 | 195 | very high |
| 5 | W whiskers | 287 | 5.5 | 560 | very high |
| 6 | $Al_2O_3$ powder | 215 | 5.1 | 190 | very low |
| 7 | Zinc white #1 | 155 | 3.6 | 155 | very low |
| 8 | Larger-sized zinc oxide whiskers | 60 | 3.1 | 125 | very low |
| 9 | Smaller-sized zinc oxide whiskers | 140 | 3.0 | 142 | very low |

As will be apparent from the above table, the anisotropy of the strength is substantially negligible especially when the tetrapod form is kept. The machinability is better than those attained by the known whiskers or other fillers. In addition, the cost of the zinc oxide whiskers is so low as that of $Al_2O_3$ powder, zinc white and the like.

EXAMPLE 4

Zinc oxide whiskers of a tetrapod form whose needle crystal projections or portions had a diameter of from 2 to 8 μmϕ at its basal part and a length of from the basal part to the tip of from 10 to 80 micrometers were made. The whiskers were dispersed in aluminum alloy No. 2014 in an amount of 15% by volume and extruded by powder metallurgy at 700° C., thereby obtaining round bars with a diameter of 6 m mϕ.

The broken surface of the bar was observed through a reflection-type electron microscope, revealing that most large-sized, tetrapod-shaped whiskers were converted into needle-like whiskers with an aspect ratio of from 2 to 50.

The bars were subjected to measurements of free cuttability and tensile strength. The results are shown in Table 2.

The free cuttability was evaluated totally with respect to the cutting time of the test rod by the use of a saw at a constant pressure, the maximum length of the burr occurring at the cut surface and the surface roughness (Ra) on the cut surface.

COMPARATIVE EXAMPLES 10 TO 19

For comparison, the general procedure of Example 4 was repeated using filler-free aluminum alloy No. 2014, combinations of the alloy No. 2014 and, as a filler, glass fibers, talc, mica, alumina powder, silicon carbide whiskers, potassium titanate whiskers, zinc white #1 obtained by the French method with an average size of 0.52 micrometers, larger-sized zinc oxide whiskers whose needle crystal projections a diameter of basal part of from 14 to 20 micrometers and a length of from 200 to 300 micrometers, and smaller-sized zinc oxide whiskers whose needle crystal projections having a length of from 0.5 to 3 micrometers and a basal part diameter of from 0.05 to 0.7 micrometers, thereby obtaining aluminum alloy test pieces with or without containing the above fillers. The test pieces were evaluated in the same manner as in Example 4. The results are shown in Table 2.

TABLE 2

| | Filler | Cutting Time (Index to that of Comp. Ex. 10) | Maximum Length Burr (mm) | Surface Roughness, Ra, (μm) | Tensile Strength (Index to that of Comp. Ex. 10) |
|---|---|---|---|---|---|
| Example 4 | zinc oxide whiskers | 45 | 0.25 | 45 | 150 |
| Comp. Ex. | | | | | |
| 10 | no | 100 | 3.5 | 250 | 100 |
| 11 | glass fibers | 210 | 4.2 | 370 | — |
| 12 | talc | 73 | 1.1 | 110 | 55 |
| 13 | mica | 82 | 1.0 | 98 | 43 |
| 14 | alumina powder | 124 | 3.7 | 280 | 70 |
| 15 | silicon carbide whiskers | 180 | 3.2 | 170 | 140 |
| 16 | potassium titanate whiskers | 155 | 3.5 | 165 | 135 |
| 17 | zinc white #1 | 155 | 3.5 | 150 | 85 |
| 18 | Larger-sized zinc oxide whiskers | 60 | 3.2 | 110 | 115 |
| 19 | Smaller-sized zinc oxide whiskers | 150 | 3.1 | 139 | 99 |

Note:
the values are each an average value of ten measurements.

What is claimed is:

1. A metal composition which comprises a mixture of a metal and whiskers of zinc oxide dispersed in the metal matrix, each zinc oxide whisker having at least one needle crystal which includes a basal part having a diameter of from 0.7 to 14 micrometers and having a length from the basal part to the tip of from 3 to 200 micrometers.

2. A metal composition according to claim 1, wherein said whiskers comprise zinc oxide whiskers each having a central body and a plurality of needle crystal projections extending radially from the central body.

3. A metal composition according to claim 2, wherein said whiskers consists essentially of the zinc oxide whiskers.

4. A metal composition according to claim 2, wherein said whiskers comprise a mixture of zinc oxide whiskers having central bodies and one, two, three and/or four needle crystal projections extending from the central bodies, respectively, and needle crystals.

5. A metal composition according to claim 2, wherein said plurality of needle crystal projections are four needle crystal projections.

6. A metal composition according to claim 1, wherein said whiskers are contained in an amount of from 0.1 to 50% by volume of the composition whereby the free cuttability of the metal composition is improved.

7. A metal composition according to claim 6, wherein the amount is from 5 to 30% by volume.

8. A metal composition according to claim 1, wherein said whiskers are contained in an amount of from 5 to 50% by volume of the composition wherein the metal composition is mechanically reinforced.

9. A metal composition according to claim 8, wherein the amount is from 8 to 30% by volume.

10. A metal composition according to claim 1, wherein said metal is a member selected from the group consisting of simple substances mainly composed of titanium, aluminum, copper, lead, magnesium, tin, zinc, beryllium, calcium, strontium, barium, scandium, lanthanum, manganese, silver, gold, cadmium, mercury, gallium, indium, thalium, germanium, arsenic, antimony, bismuth, selenium, tellurium, uranium, neodium, lithium, sodium, potassium, cesium and cerium rubidium, and alloys of one or more metals defined above.

11. A metal composition according to claim 10, wherein said metal is aluminum or its alloy.

12. A metal composition according to claim 10, wherein said metal is copper or its alloy.

13. A metal composition according to claim 10, wherein said metal is magnesium or its alloy.

14. A metal composition according to claim 10, wherein said metal is titanium or its alloy.

15. A metal composition according to claim 10, further comprising at least one high melting metal selected from the group consisting of yttrium, zirconium, hafnium, vanadium, niobium, tantalum, chromium, molybdenum, tungsten, iron, ruthenium, osmium, cobalt, rhodium, iridium, nickel, palladium, platinum, technetium and rhenium.

16. A metal composition according to claim 1, wherein the diameter of the basal part is from 0.9 to 10 micrometers and the length of from 10 to 140 micrometers.

17. A metal composition according to claim 16, wherein the diameter is from 0.9 to 1.8 micrometers and the length is from 10 to 30 micrometers.

18. A metal composition according to claim 1, further comprising up to 30% by volume of whiskers, powders, flakes, long or short fibers of a metal or inorganic material.

* * * * *